US006264426B1

(12) United States Patent
Fukuno et al.

(10) Patent No.: US 6,264,426 B1
(45) Date of Patent: Jul. 24, 2001

(54) GAS TURBINE STATIONARY BLADE

(75) Inventors: Hiroki Fukuno; Yasuoki Tomita; Kiyoshi Suenaga, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/026,643

(22) Filed: Feb. 20, 1998

(30) Foreign Application Priority Data

Feb. 20, 1997 (JP) ..... 9-036108

(51) Int. Cl.[7] ..... F01D 5/18
(52) U.S. Cl. ..... 415/115; 416/96 R; 416/97 R
(58) Field of Search ..... 415/115, 116; 416/96 R, 96 A, 97 R

(56) References Cited

U.S. PATENT DOCUMENTS

| | | | | |
|---|---|---|---|---|
| 5,253,976 | * | 10/1993 | Cunha | 415/115 |
| 5,320,483 | | 6/1994 | Cunha et al. . | |
| 5,413,458 | * | 5/1995 | Calderbank | 415/115 |
| 5,536,143 | * | 7/1996 | Jacala et al. | 416/96 R |
| 5,634,766 | * | 6/1997 | Cunha et al. | 415/115 |
| 5,639,216 | * | 6/1997 | McLaurin et al. | 416/96 R |
| 5,695,321 | * | 12/1997 | Kercher | 415/115 |

FOREIGN PATENT DOCUMENTS 0 392 664 10/1990 (EP) .

OTHER PUBLICATIONS

European Search Report, Appl. No. EP 98 30 0983, completed Jan. 14, 1999 by F. Raspo.

* cited by examiner

*Primary Examiner*—Christopher Verdier
*Assistant Examiner*—Richard Woo
(74) *Attorney, Agent, or Firm*—Alston & Bird LLp

(57) ABSTRACT

In cooling a gas turbine stationary blade, steam and air are used as cooling media, the steam is recovered surely without leakage and used effectively, and the amount of air required for cooling is decreased to provide a margin for combustion air, by which the gas turbine efficiency is improved. A steam cooling section is provided at the rear from the blade leading edge, and an air cooling section is provided at the blade trailing edge. The steam cooling is effected by cooling the blade by the cooling steam flowing in the serpentine flow path having turbulators after impingement cooling of an outside shroud and by impingement-cooling an inside shroud during the cooling process, the cooling steam being led to a recovery section from the outside shroud. On the other hand, the air cooling section consists of an air flow path extending from the outside shroud to the inside shroud and slot cooling at the blade trailing edge. Thus, the stationary blade is cooled by both of the steam cooling section and air cooling section.

2 Claims, 3 Drawing Sheets

GAS TURBINE STATIONARY BLADE

FIELD OF THE INVENTION AND RELATED ART STATEMENT

The present invention relates to a stationary blade for a gas turbine in which cooling is effected by using both steam and air as cooling media.

The prior art will be described with reference to FIG. 4. FIG. 4 is a sectional view of a conventional cooled stationary blade for gas turbine.

A cooled stationary blade 51 is integrally formed together with outside and inside shrouds (not shown) by precision casting. Inserts 54A and 54B having many cooling holes 53 are inserted in the cooled stationary blade 51, and cooling air is supplied into the inserts 54A and 54B through the outside shroud.

The cooling air flows out through the cooling holes 53 as indicated by arrows, and flows into a hollow chamber A after effecting impingement cooling by colliding with the inner wall of the cooled stationary blade 51. Subsequently, the cooling air cools the cooled stationary blade 51 while flowing toward the trailing edge of blade. Part of the cooling air forms a cooling film on the blade surface by flowing out through film cooling holes 52 and 55 and flowing along the blade profile, whereby film cooling is effected.

The cooling air flowing out through a slit 56 at the blade trailing edge convection-cools the blade trailing edge including pin fins 57. Also, the cooling air flowing out through a cooling hole 58 at the blade leading edge shower-cools the blade leading edge.

Although not shown in the figure, the outside and inside shrouds are provided with an impingement plate and pin fins, and impingement cooling and pin fin cooling are effected by the cooling air before it is supplied to the inserts 54A and 54B.

As the efficiency of gas turbine has increased recently, the inlet temperature has increased. An inlet temperature of about 1500° C. cannot be overcome by the air cooling only because air has a low heat capacity and the air cooling requires a large amount of air. For this reason, steam has begun to be used as a cooling medium because steam has a higher heat capacity than air and a smaller amount thereof is required.

In the process of development of technology for accommodating such a change of needs, it was thought that the stationary blade portions that can be air-cooled are cooled by air, and on the other hand, the stationary blade portions that are difficult to be air-cooled are cooled by steam.

However, in the case where steam cooling is effected in such a manner, extraction steam of a steam turbine constituting a combined cycle, waste heat boiler steam, and the like are used, so that the complete elimination of steam leakage into the gas turbine is required in view of the efficiency of steam cycle.

Therefore, the cooling medium passage must be closed to the outside and have supply and recovery ports of steam.

Also, because both of steam and air are used as cooling media, the whole system including the outside and inside shrouds, not to mention the blade itself is required to be cooled by using both cooling media without relying on either one cooling medium only in view of the control balance of the whole system etc.

OBJECT AND SUMMARY OF THE INVENTION

The present invention was made in view of this situation, and accordingly an object thereof is to provide a gas turbine stationary blade in which every necessary place is cooled by effectively using both cooling media of steam and air in a well-balanced manner, and the cooling steam is used without leakage.

Accordingly, the present invention for solving the above problems provides a gas turbine stationary blade provided with a steam cooling section at the rear from the leading edge of blade and an air cooling section at the trailing edge of blade, in which the steam cooling section comprises a cooling steam supply portion having an impingement plate, which is formed at the end of an outside shroud; a serpentine flow path extending in the blade length direction from the cooling steam supply portion and turns plural times; many turbulators arranged on the inner wall of the serpentine flow path so as to extend slantwise with respect to the flow; an inside impingement plate provided in an inside shroud at the final turning portion of the serpentine flow path; and a steam recovery port formed in the outside shroud at a downstream position of the serpentine flow path turned at the inside impingement plate, and the air cooling section comprises an air flow path extending at the rear of the steam cooling section from the outer edge of the outside shroud to the outer edge of the inside shroud and having many turbulators arranged on the inner wall so as to extend slantwise with respect to the flow; slot holes provided at the trailing edge of blade; and a cooling air supply portion for supplying the cooling air to the slot holes. The cooling steam cools the portion at the rear from the blade leading edge with a higher temperature. First, the cooling steam impingement-cools the outside shroud, and then cools the blade while flowing in the serpentine flow path in the lengthwise direction in a turbulent flow state by being turned. It impingement-cools the inside shroud during the flow, and is finally transferred to a predetermined recovery system from the outside shroud. On the other hand, the cooling air cools the trailing edge portion of blade. The cooling air flows in the air flow path in the blade length direction in a turbulent flow state to cool the blade, and effects slot cooling in which the cooling air passes through the slot holes to the gas flow path at the trailing edge of blade. Desirable blade cooling is effected by the cooperation of steam cooling and air cooling, and in steam cooling, the cooling steam is guided without leakage during the cooling process and recovered surely in a predetermined manner, by which the efficiency is improved variously.

According to the present invention, the gas turbine stationary blade is provided with a steam cooling section at the rear from the leading edge of blade and an air cooling section at the trailing edge of blade. The steam cooling section comprises a cooling steam supply portion having an impingement plate, which is formed at the end of an outside shroud; a serpentine flow path extending in the blade length direction from the cooling steam supply portion and turns plural times; many turbulators arranged on the inner wall of the serpentine flow path so as to extend slantwise with respect to the flow; an inside impingement plate provided in an inside shroud at the final turning portion of the serpentine flow path; and a steam recovery port formed in the outside shroud at a downstream position of the serpentine flow path turned at the inside impingement plate. The air cooling section comprises an air flow path extending at the rear of the steam cooling section from the outer edge of the outside shroud to the outer edge of the inside shroud and having many turbulators arranged on the inner wall so as to extend slantwise with respect to the flow; slot holes provided at the trailing edge of blade; and a cooling air supply portion for supplying the cooling air to the slot holes. The gas turbine stationary blade configured as described above has the following effects.

The gas turbine stationary blade, which has a high temperature in operation, is cooled by both of the steam cooling section and air cooling section. In the steam cooling section, the cooling steam flows in the serpentine flow path in the blade at the rear from the leading edge while impingement-cooling the outside and inside shrouds. In the air cooling section, the air flow path cooling and slot cooling are combined at the trailing edge. Moreover, in the steam cooling, the heated cooling steam is recovered surely and reused. Also, because steam has a high heat capacity, the total fluid flow of steam plus air is significantly decreased as compared with the case where cooling is effected by air only. Further, a great decrease in use of air as a cooling medium provides a margin for combustion air, resulting in the improvement in gas turbine efficiency.

DETAILED DESCRIPTION OF PREFERRED EMBODIMENTS

Figure 1:
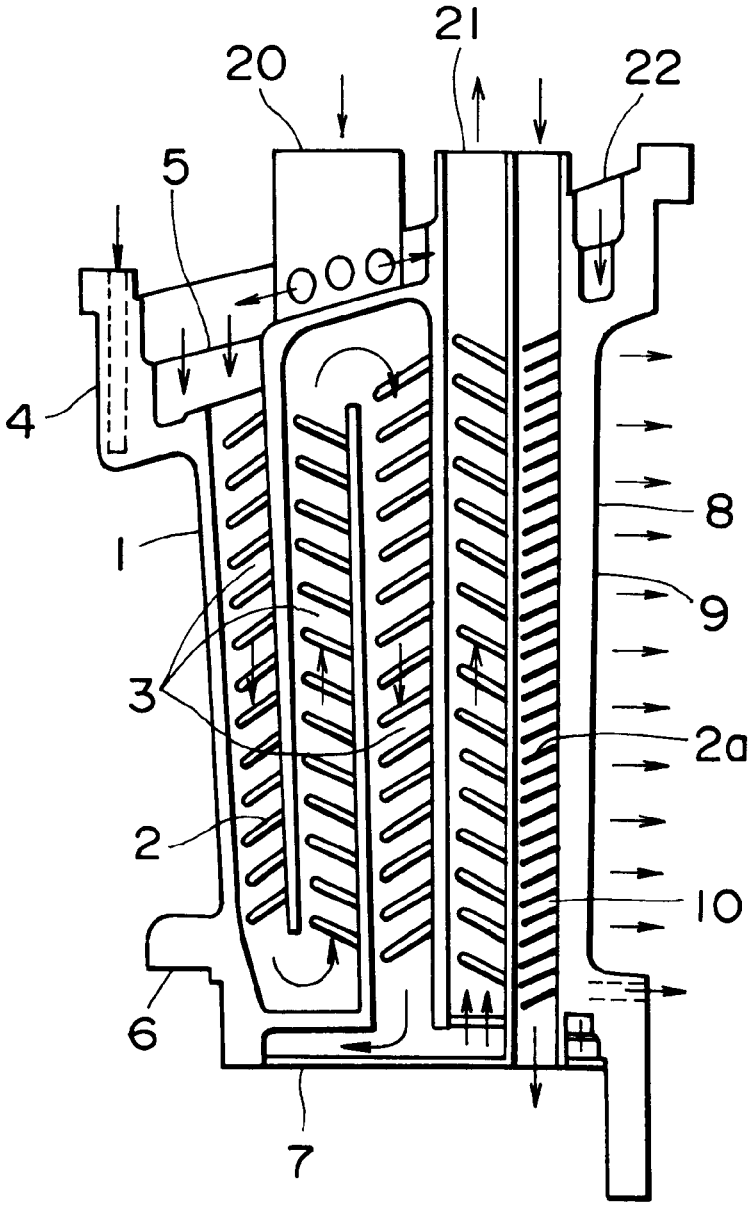
FIG. 1 is a longitudinal sectional view showing one embodiment of a cooled stationary blade for a gas turbine in accordance with the present invention.
Figure 2:
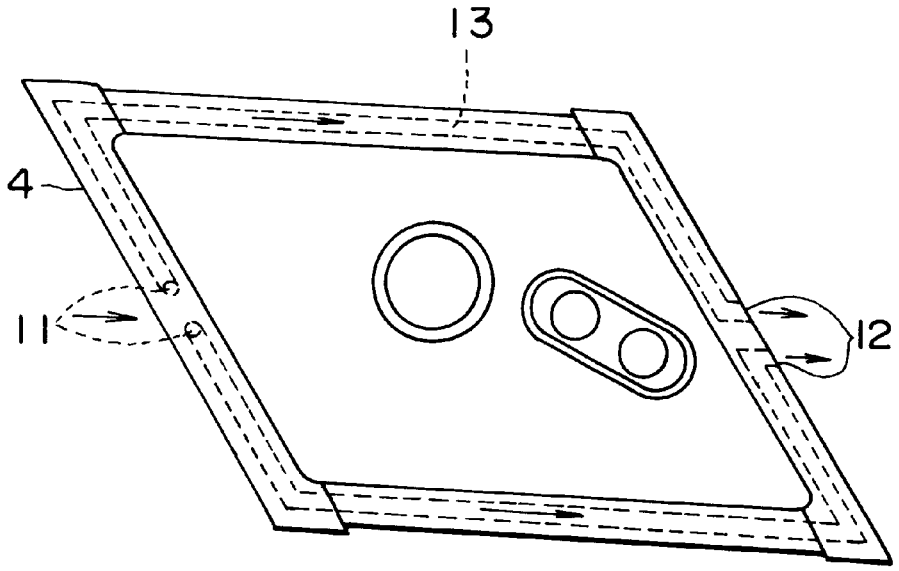
FIG. 2 is a plan view of an outside shroud, which is a part of FIG. 1.
Figure 3:
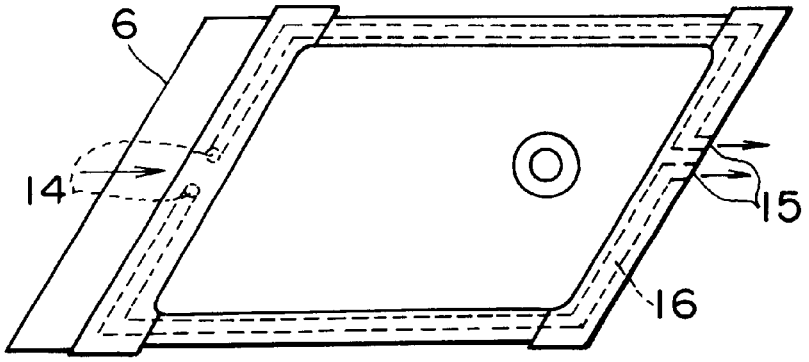
FIG. 3 is a plan view of an inside shroud, which is a part of FIG. 1.
Figure 4:
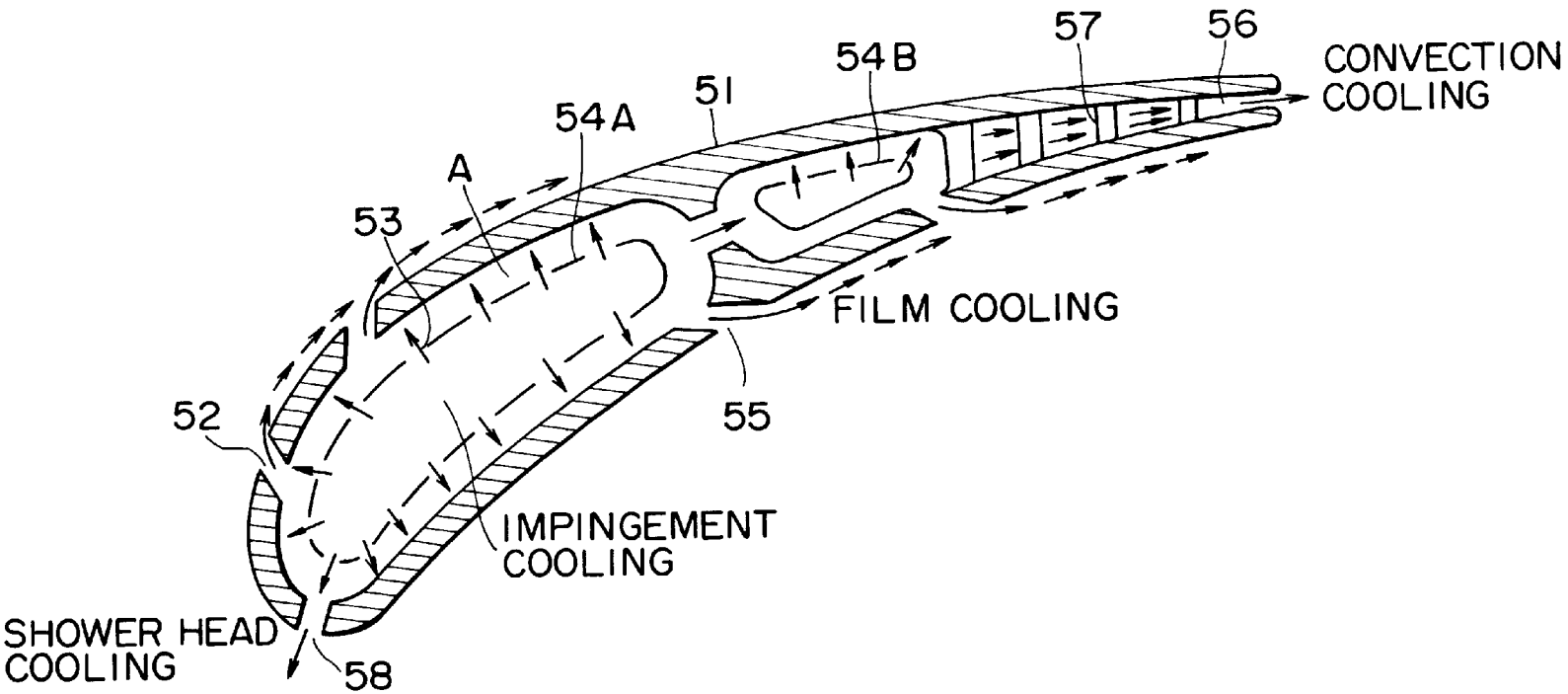
FIG. 4 RELATED ART
FIG. 4 is a transverse sectional view of a conventional gas turbine stationary blade.

One embodiment of the present invention will be described with reference to FIGS. 1 to 3. FIG. 1 is a sectional view of a cooled stationary blade for a gas turbine, FIG. 2 is a plan view of an outside shroud, and FIG. 3 is a plan view of an inside shroud.

Reference numeral 1 denotes a gas turbine stationary blade, and 3 denotes a serpentine flow path formed in the stationary blade 1. The serpentine flow path 3 is named because it extends in the lengthwise direction of the stationary blade 1 and lies in a zigzag line by turning on the outer and inner peripheral sides.

Many turbulators 2 projecting from the inner wall of serpentine flow path 3 are provided at predetermined intervals over almost the entire region of the serpentine flow path 3. The turbulators 2 extend in such a direction as to slantwise intersect the flow direction of fluid flowing in the serpentine flow path 3 and are arranged substantially in parallel with each other.

Therefore, the fluid flowing in the serpentine flow path 3 collides with the turbulators 2 on the inner peripheral surface so that a turbulent flow is produced, preventing the formation of a laminar flow state which has a poor heat transfer.

An outside shroud 4 is formed integrally with the end portion of the stationary blade 1 on the outside with the turbine rotation shaft being the center.

An impingement plate 5 formed with many holes (not shown) is provided in the outside shroud 4 to impingement-cool the cooling steam supplied through a steam supply port 20 toward the outside shroud 4.

An inside shroud 6 is formed integrally on the inside in the radial direction of the stationary blade 1 so as to lie opposite to the outside shroud 4.

An inside impingement plate 7 is provided in the inside shroud 6 to impingement-cool the inside shroud 6 by supplying the cooling steam at the final turning portion of the serpentine flow path 3 and ejecting the cooling steam through many holes (not shown).

A steam recovery port 21 is provided in the outside shroud 4 to form an outlet for delivering the cooling steam flowing out of the end of the serpentine flow path 3 to an external recovery system (not shown).

That is, a steam cooling section is formed by a series of related structures ranging from the aforesaid steam supply port 20 to this steam recovery port 21.

A trailing edge 8 of the stationary blade 1 is formed with many slot holes 9 distributed in the blade length direction, though not shown clearly in the figure.

An air flow path 10 for supplying the cooling air is provided at the rear of the serpentine flow path 3 of the steam cooling section and in front of the slot holes 9. The inner wall of the air flow path 10 is provided with many turbulators 2*a* extending slantwise with respect to the flow of cooling air. An air supply port 22 of the air flow path 10 is formed at the outer edge of the outside shroud 4, and the air flow path 10 extends to the outer edge of the inside shroud 6.

In the outside and inside shrouds 4 and 6, air flow paths 13 and 16 are arranged, respectively, so as to surround the outer periphery of the shroud in order to let the cooling air flow. The air flow path 13 of the outside shroud 4 is provided with an air inlet 11 and an air outlet 12, while the air flow path 16 of the inside shroud 6 is provided with an air inlet 14 and an air outlet 15, by which a construction for effecting air cooling is provided.

In this embodiment configured as described above, in the interior of the gas turbine stationary blade 1, many turbulators 2*a* are disposed slantwise, the serpentine flow path 3 turning plural times is provided, and the cooling steam is supplied through the steam cooling impingement plate 5 provided in the outside shroud 4.

The cooling steam flows in the serpentine flow path 3 along its arrangement by being turned, cools the inside shroud 6 by means of the inside impingement plate 7 of the inside shroud 6, and then is turned again and flows in the serpentine flow path 3. Finally, the cooling steam is recovered through the steam recovery port 21 provided in the outside shroud 4.

On the other hand, at the trailing edge 8 of the stationary blade 1, the air flow path 10 formed with many slot holes 9 and adjacent to the trailing edge 8 is configured so that the air supply port 22 communicates with the air flow path 13 provided at the outer edge of the outside shroud 4, and the opposite outlet communicates with the air flow path 16 provided at the outer edge of the inside shroud 6. Therefore, the cooling air flows in this path, by which predetermined cooling is effected.

Thus, this embodiment achieves various effects: The stationary blade 1 is cooled separately by two kinds of cooling media, steam and air, so that in the steam cooling system, the steam used for cooling is recovered surely and the heated steam is reused. Also, the use of steam having a higher heat capacity than that of air significantly decreases the total fluid flow of steam plus air as compared with the case where cooling is effected by air only. Further, the decrease in use of cooling air improves the efficiency of gas turbine by providing a margin for combustion air.

The above is the description of one embodiment of the present invention, and the present invention is not limited to this embodiment. Needless to say, the specific construction may be modified variously within the scope of the present invention.

What is claimed is:

1. A gas turbine stationary blade comprising:

a blade, an outer shroud attached to an outer end of the blade, and an inner shroud attached to an inner end of the blade;

a steam cooling section adjacent a leading edge of the blade and extending in a downstream direction therefrom, the steam cooling section comprising a cooling steam supply port in the outer shroud, a serpentine flow path contained within the blade and adapted to receive cooling steam from the supply port such that the cooling steam first flows along the leading edge of the blade and then proceeds downstream, and a steam recovery port formed in the outer shroud at a downstream end of the steam cooling section, the serpentine flow path including a plurality of turns and having turbulators extending from inner surfaces of the flow path slantwise to the steam flow direction;

an air cooling section adjacent the downstream end of the steam cooling section and comprising an air flow path extending lengthwise through the blade from the outer shroud to the inner shroud, slot holes formed in the blade at the trailing edge thereof, and a cooling air supply port for supplying the cooling air to the slot holes, the air flow path having turbulators extending from inner surfaces of the air flow path slantwise to the air flow direction; and an inner impingement plate formed at the inner shroud and positioned adjacent a final turn of the serpentine flow path such that the cooling steam passes through the inner impingement plate to cool the inner shroud and is then turned through the final turn at the inner shroud to flow back to the outer shroud where all of the cooling steam is then recovered through the steam recovery port at the outer shroud.

2. The gas turbine stationary blade of claim 1, further comprising an impingement plate formed at the outer shroud and positioned to be impinged by cooling steam from the cooling steam supply port for impingement cooling of the outer shroud.

* * * * *